US007256745B2

(12) United States Patent
Saito et al.

(10) Patent No.: US 7,256,745 B2
(45) **Date of Patent: *Aug. 14, 2007**

(54) FIXING DEVICE FOR FIXING AN OBJECT TO A FIXING PLATE AND ANTENNA APPARATUS USING THE FIXING DEVICE

(75) Inventors: Yuichi Saito, Akita (JP); Kyuichi Sato, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/024,634

(22) Filed: Dec. 29, 2004

(65) Prior Publication Data

US 2005/0184923 A1 Aug. 25, 2005

(30) Foreign Application Priority Data

Feb. 23, 2004 (JP) ..... 2004-045945

(51) Int. Cl.
*H01Q 1/32* (2006.01)

(52) U.S. Cl. ..... 343/713; 343/878

(58) Field of Classification Search ..... 343/711, 343/713, 878, 715

See application file for complete search history.

(56) References Cited

U.S. PATENT DOCUMENTS 3,120,640 A * 2/1964 Midlock et al. ..... 455/90.3
3,729,741 A * 4/1973 Otto ..... 343/713
4,114,159 A * 9/1978 Verini ..... 343/715
5,106,225 A 4/1992 Andre et al.
5,585,809 A * 12/1996 Yajima et al. ..... 343/713
5,900,840 A * 5/1999 Yajima ..... 343/713
6,157,345 A * 12/2000 Hockett et al. ..... 343/715
6,294,740 B1 * 9/2001 Van Swearingen ..... 174/151
6,486,841 B1 * 11/2002 Imahigashi ..... 343/715
6,762,727 B2 7/2004 Rochford et al.

(Continued)

FOREIGN PATENT DOCUMENTS

JP 5-88007 U 11/1993

OTHER PUBLICATIONS

U.S. Appl. No. 11/068,673, filed Feb. 28, 2005, Noro et al.

*Primary Examiner*—Tho Phan
(74) *Attorney, Agent, or Firm*—Frishauf, Holtz, Goodman & Chick, P.C.

(57) ABSTRACT

For fixing an object to a fixing plate by a fixing portion of the object and a fixing member, a fixing device includes a first screw member formed on the object and a second screw member corresponding to the first screw member. The fixing member includes a bottom plate portion provided with a through hole allowing a threaded portion of the second screw member to pass therethrough and a plurality of spring portions extending from the bottom plate portion in one direction. The bottom plate portion has an outer dimension smaller than a fixing hole formed on the fixing plate. A combination of the spring portions extends in the one direction from the bottom plate portion having an outer dimension greater than the fixing hole in at least an upper part thereof. Each of the spring portions has lateral sides provided with cut-away portions formed by cutting the lateral sides from the bottom plate portion in the one direction.

22 Claims, 6 Drawing Sheets

U.S. PATENT DOCUMENTS

| | | | | |
|---|---|---|---|---|
| 6,812,897 | B2 * | 11/2004 | Jarmuszewski et al. | 343/702 |
| 6,930,643 | B2 | 8/2005 | Byrne et al. | |
| 2003/0068198 | A1 | 4/2003 | Kozlovski | |
| 2004/0133205 | A1 | 7/2004 | Thramann et al. | |
| 2005/0024280 | A1 | 2/2005 | Takahashi | |
| 2005/0184923 | A1 | 8/2005 | Saito et al. | |
| 2005/0242280 | A1 | 11/2005 | Nikolaev | |
| 2006/0056911 | A1 | 3/2006 | Noro et al. | |

* cited by examiner

FIXING DEVICE FOR FIXING AN OBJECT TO A FIXING PLATE AND ANTENNA APPARATUS USING THE FIXING DEVICE

This application claims priority to prior Japanese patent application JP 2004-45945, the disclosure of which is incorporated herein by reference.

BACKGROUND OF THE INVENTION

This inventor, relates to a fixing device for fixing an object to a fixing plate by the use of a screw member and to an antenna apparatus using the fixing device.

Recently, a digital radio receiver adapted to receive a satellite wave or a ground wave so as to listen to digital radio broadcasting is put into practical use. The digital radio receiver is mounted to a mobile station. Specifically, the digital radio receiver is adapted to receive a radio wave having a frequency of about 2.3 GHz as a reception wave. The reception wavelength (resonance wavelength) $\lambda$ is equal to about 128.3 mm. Thus, the digital radio receiver is capable of listening to the digital radio broadcasting.

Thus, the digital radio receiver is a radio receiver adapted to listen to mobile broadcasting. The ground wave is obtained by slightly shifting the frequency of the satellite wave after the satellite wave is received by a ground station, and is re-transmitted with linear polarization.

An antenna for receiving the radio wave is disposed outside the mobile station. In case where the digital radio receiver is mounted to an automobile, the antenna is generally attached to a roof plate of the automobile.

For example, Japanese Utility Model Application Publication (JP-U) No. H5-88007 discloses a mounting structure of an automobile antenna, in which a case containing the antenna can be attached to a mounting member at a desired angle.

In the above-mentioned mounting structure, a cable can be extracted from a cable fitting groove formed on a lower surface of the case to the outside at any desired angle. The mounting member is provided with a fitting hole having four convex portions protruding from a center space, and a plurality of mounting portions formed on one side thereof as bent portions.

However, the above-mentioned mounting structure using the mounting member is disadvantageous in the following respects. The mounting member is provided with a number of mounting screw holes. The case is attached to the mounting member by the use of various kinds of screws, such as a mounting screw, a screw with a hexagonal hole, and so on. Therefore, the number of parts is increased and a mounting operation is complicated. Thus, it is difficult to perform the mounting operation smoothly.

SUMMARY OF THE INVENTION

It is an object of this invention to provide a fixing device capable of easily and smoothly performing an operation of fixing an object to a fixing plate.

It is another object of this invention to provide an antenna apparatus using the above-mentioned fixing device.

Other objects of the present invention will become clear as the description proceeds.

According to one affect of this invention, there is provided a fixing device for fixing an object to a fixing plate by a fixing portion of the object and a fixing member, the fixing device comprising a first screw member formed on the object and a second screw member corresponding to the first screw member, the fixing member comprising a bottom plate portion provided with a through hole allowing a threaded portion of the second screw member to pass therethrough and a plurality of spring portions extending from the bottom plate portion in one direction, the bottom plate portion having an outer dimension smaller than a fixing hole formed on the fixing plate, a combination of the spring portions extending in the one direction from the bottom plate portion having an outer dimension grater than the fixing hole in at least an upper part thereof, each of the spring portions having lateral sides provided with cut-away portions formed by cutting the lateral sides from the bottom plate portion in the one direction.

DESCRIPTION OF THE PREFERRED EMBODIMENTS

Figure 1:
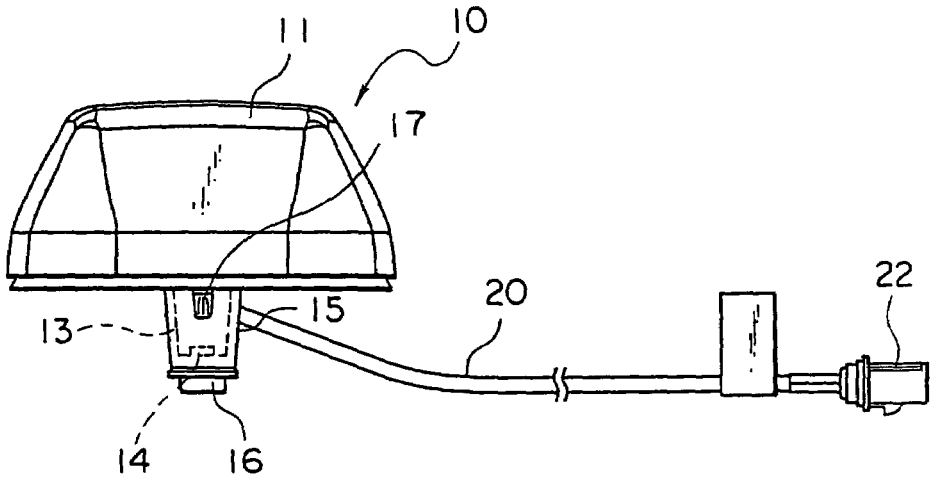
FIG. 1 is a front view of an antenna apparatus using a fixing device according to an embodiment of this invention.
Figure 2:
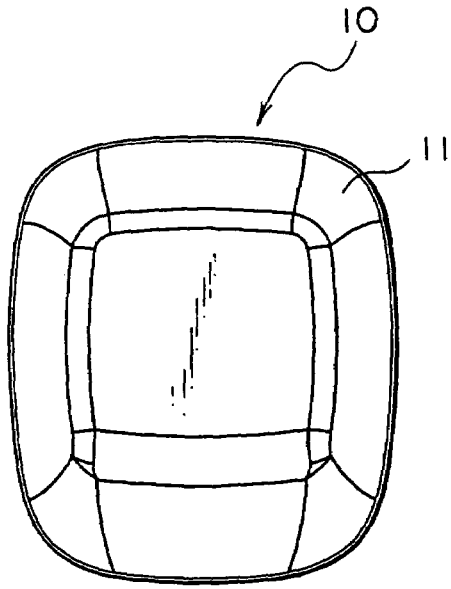
FIG. 2 is a plan view of the antenna apparatus in FIG. 1 without a cable.
Figure 3:
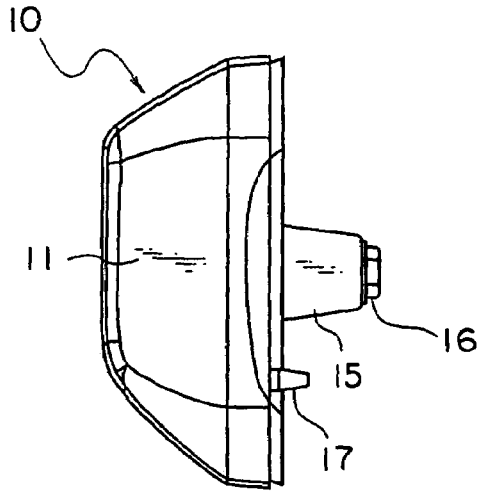
FIG. 3 is a right side view of the antenna apparatus in FIG. 2.
Figure 4:
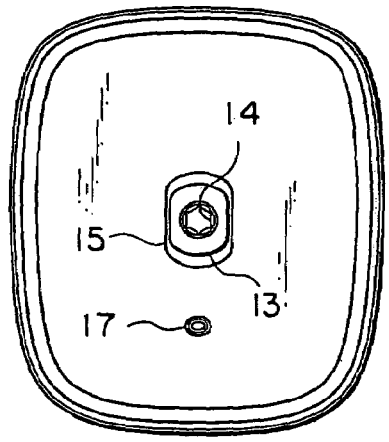
FIG. 4 is a bottom view of the antenna apparatus in FIG. 2.

Now, with reference to the drawing, description will be made of a fixing device for fixing an object to a fixing plate according to this invention. In this embodiment, consideration will be made about an automobile antenna apparatus (hereinafter simply referred to as an antenna apparatus) by way of example.

Referring to FIGS. 1 through 4, an antenna apparatus (object) 10 using a fixing device for fixing an object to a fixing plate comprises a case 11 of a small dome-like shape and a fixing portion 13 integrally formed with the case 11.

The case 11 contains an antenna element (not shown). The fixing portion 13 is formed at an approximate center of a bottom surface of the case 11 and protrudes downward from the bottom surface. The fixing portion 13 has a female screw (first screw member) 14 formed inside. The fixing portion 13 is covered with a bracket (fixing member) 15. The bracket 15 is fixed to the fixing portion 13 by screw engagement between the female screw 14 and a male screw (second screw member) 16.

Figure 5:
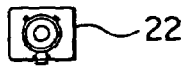
FIG. 5 is a right side view of a plug connected to the antenna apparatus in FIG. 1.

On the bottom surface of the case 11, a locator pin 17 is formed at a position deviated from the center of the bottom surface and protrudes downward from the bottom surface. A cable 20 is led into the case 11. The cable 20 has one end connected to the antenna element (not shown) contained in the case 11. The cable 20 extending outside the case 11 has the other end connected to a plug 22 also shown in FIG. 5. In this embodiment, the cable 20 is a coaxial cable.

Figure 6:
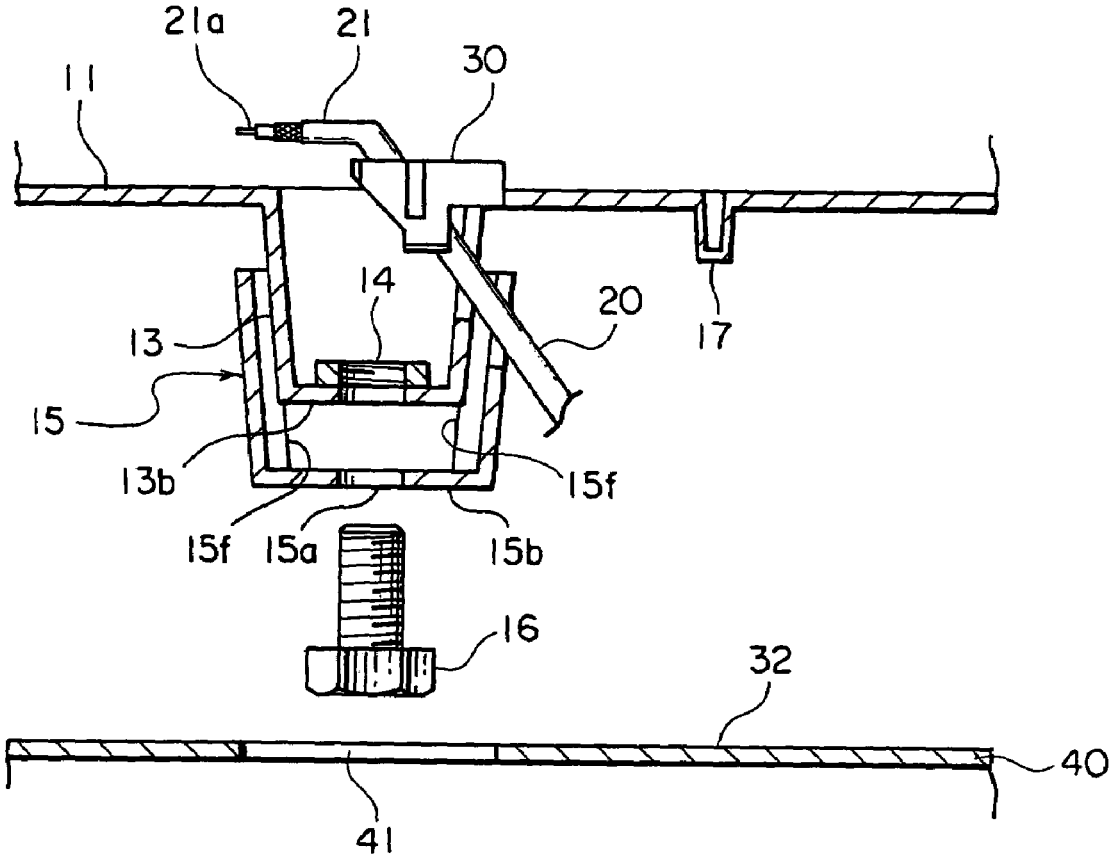
FIG. 6 is a sectional view of the antenna apparatus in FIG. 1 and a roof plate of an automobile in an exploded state.
Figure 7:
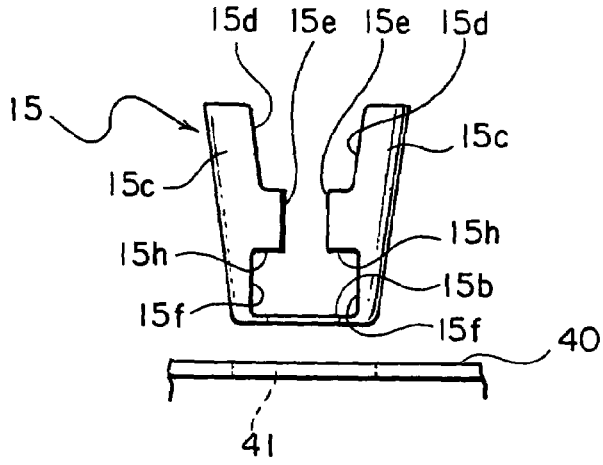
FIG. 7 is a front view showing a bracket in FIG. 1 and a part of the roof plate of the automobile.
Figure 8:
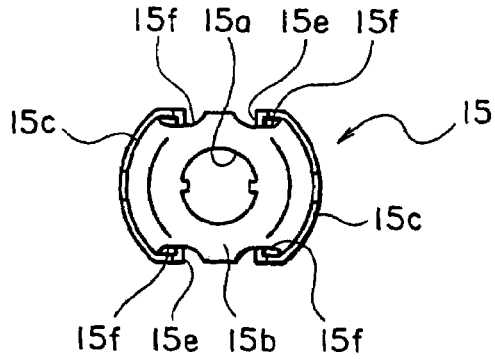
FIG. 8 is a plan view of the bracket in FIG. 7.
Figure 9:
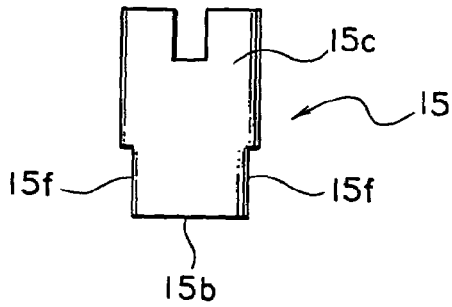
FIG. 9 is a side view of the bracket in FIG. 7.

FIG. 6 shows a state before the antenna apparatus 10 is fixed to a roof plate (fixing plate) 40 as an outer plate of an automobile. FIG. 7 shows the bracket 15 and the roof plate 40. FIGS. 8 and 9 show the bracket 15 in different views.

Referring to FIGS. 6 through 9, the bracket 15 has a bottom plate portion 15*b* provided with a through hole 15*a* of a generally circular shape and a pair of spring portions 15*c* extending upward from the bottom plate portion 15*b*.

The through hole 15*a* allows a threaded portion of the male screw 16 to pass therethrough from the outside of the bottom plate portion 15*b*. The spring portions 15*c* extend from the bottom plate portion 15*b* upward (in one direction) in such a manner that a space between the spring portions 15*c* is widened upward.

Each of the spring portions 15*c* has a generally arc-shaped surface generally concentric with the through hole 15*a*. Each of the spring portions 15*c* has a pair of lateral sides 15*d* with a pair of guide portions 15*e* formed at intermediate portions thereof. The lateral sides 15*d* of the spring portions 15*c* are faced to each other in a circumferential direction with gaps left between every confronting ones. The guide portions 15*e* protrude from the lateral sides 15*d* towards the gaps between the lateral sides 15*d*.

Each of the guide portions 15*e* has a forward edge bent inward from the lateral side 15*d*. The guide portions 15*e* serve as a guide when the bracket 15 is temporarily fixed to the fixing portion 13. Further, the guide portions 15*e* serve to prevent the spring portions 15*c* from being excessively widened when the male screw 16 is tightened in order to fix the antenna apparatus 10.

As shown in FIGS. 6 and 7, the roof plate 40 has a fixing hole 41. The fixing hole 41 is slightly greater than an outer dimension of the fixing portion 13 of the antenna apparatus 10 at a position corresponding to the fixing hole 41. In other words, a clearance is present between the fixing portion 13 and the fixing hole 41.

The bottom plate portion 15*b* has an outer dimension smaller than the fixing hole 41. In other words, the fixing hole 41 allows the bottom plate portion 15*b* to easily pass therethrough. On the other hand, an outer dimension of the bracket 15 at an upper part of the spring portions 15*c* is greater than the fixing hole 41. In other words, the fixing hole 41 does not allow the upper part of the spring portions 15*c* to pass therethrough.

Each of the spring portions 15*c* has a pair of cut-sway portions 15*f*. Each of the cut-away portions 15*f* is formed by generally linearly cutting a part of the spring portion 15*c* between the bottom plate portion 15*b* and a lower end of the guide portion 15*e* and from the lateral side 15*d* towards the arc-shaped surface of the spring portion 15*c*. By forming the cut-away portions 15*f*, the bracket 15 is provided with step portions 15*h* at the intermediate portions of the lateral sides 15*d* of the spring portions 15*c*. The step portions 15*h* are substantially parallel to the bottom plate portion 15*b*.

The antenna apparatus has a positioning hole 32 formed on the roof plate 40 in correspondence to the locator pin 17. In order to mount the antenna apparatus 10 to the roof plate 40, the fixing portion 13 is faced to and inserted into the fixing hole 41 and the locator pin 17 is faced to and inserted into the positioning hole 32. Thus, the antenna apparatus 10 is oriented in a predetermined direction.

As illustrated in FIG. 6, the cable 20 has one end 21 at which a terminal end 21*a* of a core wire is exposed and connected to the antenna element. The cable 20 is extracted through the space between the spring portions 15*c* of the fixing portion 13 to the outside. The female screw 14 is formed on an inner surface of a bottom portion 13*b* of the fixing portion 13.

The one end 21 of the cable 20 is held by a cable bushing 30 inside the case 11. The plug 22 is attached to the other end of the cable 20.

When the antenna apparatus 10 is fixed to the roof plate 40, the cable 20 is connected to a receiver (not shown) disposed inside the automobile. The plug 22 is connected to the receiver.

In order to fix the antenna apparatus 10 to the roof plate 40, the following operation is required. At first, the fixing hole 41 corresponding to the fixing portion 13 of the antenna apparatus 10 is formed on the roof plate 40, as illustrated in FIGS. 6 and 7. Next, the fixing portion 13 is inserted into the fixing hole 41.

Before the fixing portion 13 is inserted into the fixing hole 41, the bracket 15 is arranged to face an outer surface of the fixing portion 13. By engaging the male screw 16 with the female screw 14, the bracket 15 is coupled and temporarily fixed to the fixing portion 13.

Then, the fixing portion 13 and the bracket 15 are inserted into the fixing hole 41. A part of the roof plate 40 is interposed between the bottom surface of the case 11 and the bracket 15 so that the antenna apparatus 10 is temporarily fixed to the roof plate 40.

When the bracket 15 is inserted into the fixing hole 41, the spring portions 15*c* of the bracket 15 are pressed by an inner edge of the fixing hole 41 to be displaced and inserted into the fixing hole 41. After the bracket 15 is inserted through the fixing hole 41 into the inside of the roof plate 40, a part of the roof plate 40 is clamped by the case 11 and upper ends of the spring portions 15*c*. At this time, the bracket 15 serves as a clip.

Figure 10:
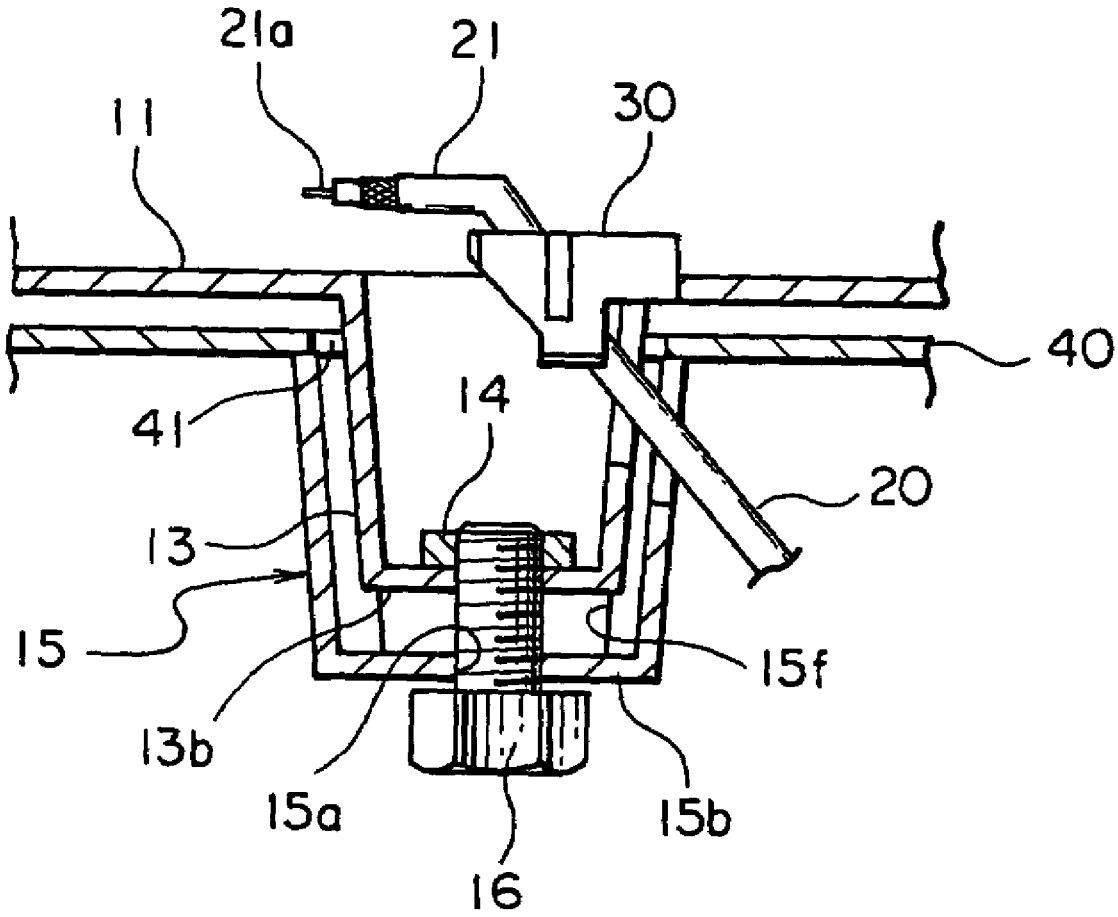
FIG. 10 is a sectional view of the antenna apparatus in FIG. 6 in an assembled state.

Thereafter, as illustrated in FIG. 10, the male screw 16 is further tightened so that the case 11 and the upper ends of the spring portions 15*c* securely clamp the roof plate 40 to fix the antenna apparatus 10 to the roof plate 40.

As described above, the antenna apparatus 10 is oriented in the predetermined direction. This is because the cable 20 is extracted in a specific direction. In addition, it is necessary to suppress an influence of a wind pressure and to avoid intrusion of wind and rain due to mismatching in shape between the roof plate 40 and the bottom surface of the case 11 of the antenna apparatus 10.

Figure 11:
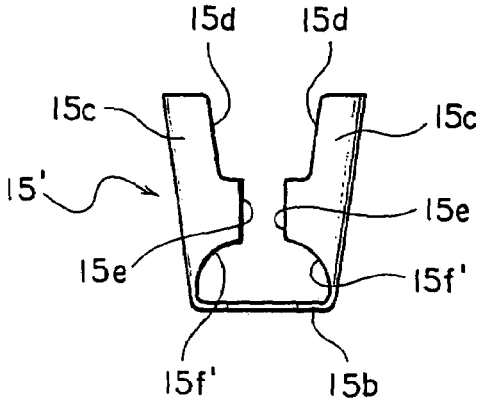
FIG. 11 is a front view of a modification of the bracket in FIG. 7.
Figure 12:
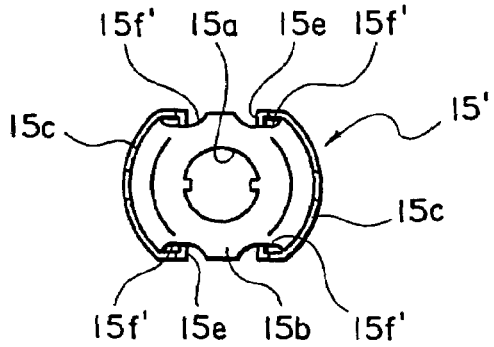
FIG. 12 is a plan view of the bracket in FIG. 11.
Figure 13:
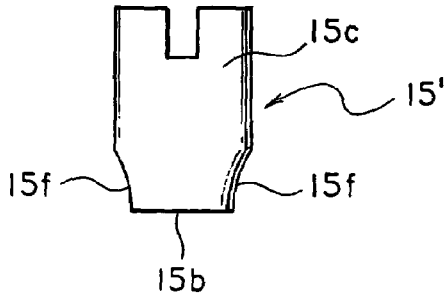
FIG. 13 is a side view of the bracket in FIG. 11.

Referring to FIGS. 11 through 13, a bracket 15' is a modification of the bracket 15 of the antenna apparatus 10 described in conjunction with FIGS. 1 through 10. The bracket 15' is similar to the bracket 15 except the following. Similar parts are designated by like reference numerals and will not be described any longer.

Referring to FIGS. 11 through 13, the bracket 15' has a bottom plate portion 15*b* provided with a through hole 15*a* allowing a threaded portion of a male screw 16 to pass therethrough, and a pair of spring portions 15*c* extending from the bottom plate portion 15*b* in one direction.

Each of the spring portions 15*c* has a pair of cut-away portions 15*f'*. Each of the cut-away portions 15*f'* is formed by arcuately cutting a part of the spring portion 15*c* between the bottom plate portion 15*b* and a lower end of a guide portion 15*e* and inward from the lateral side 15*d*.

In order to fix an antenna apparatus 10 to a roof plate 40 of an automobile, the following operation is required. At first, a fixing hole 41 corresponding to a fixing portion 13 of the antenna apparatus 10 is formed on the roof plate 40, as illustrated in FIG. 6. Next, the fixing portion 13 is inserted into the fixing hole 41. Before the fixing portion 13 is inserted into the fixing hole 41, the bracket 15 is coupled and temporarily fixed to the fixing portion 13 to cover the fixing portion 13 by engaging the male screw 16 with the female screw 14.

In the state where the bracket 15 is coupled to the fixing portion 13, the fixing portion 13 is inserted into the fixing hole 41. The bracket 15 is pressed by an inner edge of the fixing hole 41 to be displaced. At this time, the cut-away portions 15*f*' are brought into contact with the inner edge of the fixing hole 41 and the bracket 15 is easily and smoothly inserted into the fixing hole 41. Thereafter, a part of the roof plate 40 is interposed between a part of a case 11 and the bracket 15 so that the antenna apparatus 10 is temporarily fixed to the roof plate 40 of the automobile.

After the bracket 15 is temporarily fixed to the fixing portion 13, the female screw 14 and the male screw 16 are engaged with each other in the state where the bracket 15 is coupled to the fixing portion 13. Thus, the case 11 is clamped by a part of the roof plate 40 of the automobile and the bracket 15 to be securely fixed.

While this invention has thus far been described in connection with the preferred embodiment thereof, it will be readily possible for those skilled in the art to put this invention into practice in various other manners without departing from the scope set forth in the appended claims. For example, in the foregoing, consideration has been made of the case where the antenna apparatus is mounted to the roof plate of the automobile. It is noted that this invention is also applicable to any object other than the antenna apparatus and to any fixing plate other than the roof plate of the automobile. In the foregoing embodiment, the bracket produced by bending a metal plate by pressing is used as the fixing member. Alternatively, the fixing member may be produced by molding a resin material. As far as the spring portions have elasticity, the fixing member may be made of any other appropriate material.

The invention claimed is:

1. A fixing device for fixing an object to a fixing plate via a fixing portion of the object and a fixing member, the fixing device comprising:

a first screw member provided on the object; and a second screw member corresponding to the first screw member;

wherein the fixing member comprises:

a bottom plate portion which has a through hole that allows a threaded portion of the second screw member to pass therethrough, and which has an outer dimension that is smaller than a fixing hole formed in the fixing plate; and a plurality of spring portions extending from the bottom plate portion in one direction;

wherein a combination of the spring portions extending in the one direction from the bottom plate portion has an outer dimension that is greater, at least at an upper part thereof, than the fixing hole; and wherein each of the spring portions comprises lateral sides that include cut-away portions formed by cutting the lateral sides in the one direction away from the bottom plate portion; and wherein the fixing portion and the fixing member are insertable into the fixing hole when the fixing member is coupled to the fixing portion, and the object is clamped and fixed by the fixing plate and the fixing member by screw engagement between the first and the second screw members.

2. The fixing device according to claim 1, wherein each of the cut-away portions is formed by arcuately cutting each lateral side.

3. An antenna apparatus comprising the fixing device according to claim 2.

4. The fixing device according to claim 1, wherein each of the spring portions includes a guide portion which is provided at an intermediate portion of each lateral side in the one direction and protrudes from the lateral side.

5. An antenna apparatus comprising the fixing device according to claim 4.

6. The fixing device according to claim 1, wherein two of the spring portions are faced to each other to form a pair.

7. An antenna apparatus comprising the fixing device according to claim 6.

8. The fixing device according to claim 1, wherein the first screw member is provided on the fixing portion.

9. An antenna apparatus comprising the fixing device according to claim 8.

10. The fixing device according to claim 1, wherein the object is an antenna apparatus for an automobile and the fixing plate is an outer plate of the automobile.

11. An antenna apparatus comprising the fixing device according to claim 10.

12. An antenna apparatus comprising the fixing device according to claim 1.

13. A fixing device for fixing an object to a fixing plate via a fixing portion of the object and a fixing member, the fixing device comprising:

a first screw member provided on the object; and a second screw member corresponding to the first screw member;

wherein the fixing member comprises:

a bottom plate portion which has a through hole that allows a threaded portion of the second screw member to pass therethrough, and which has an outer dimension that is smaller than a fixing hole formed in the fixing plate; and a plurality of spring portions extending from the bottom plate portion in one direction;

wherein a combination of the spring portions extending in the one direction from the bottom plate portion has an outer dimension that is greater, at least at an upper part thereof, than the fixing hole;

wherein each of the spring portions comprises lateral sides that include cut-away portions formed by cutting the lateral sides in the one direction away from the bottom plate portion; and wherein each of the cut-away portions is formed by arcuately cutting each lateral side.

14. The fixing device according to claim 13, wherein each of the spring portions includes a guide portion which is provided at an intermediate portion of each lateral side in the one direction and protrudes from the lateral side.

15. An antenna apparatus comprising the fixing device according to claim 14.

16. The fixing device according to claim 13, wherein two of the spring portions are faced to each other to form a pair.

17. An antenna apparatus comprising the fixing device according to claim 16.

18. The fixing device according to claim 13, wherein the first screw member is provided on the fixing portion.

19. An antenna apparatus comprising the fixing device according to claim 18.

20. The fixing device according to claim 13, wherein the object is an antenna apparatus for an automobile and the fixing plate is an outer plate of the automobile.

21. An antenna apparatus comprising the fixing device according to claim 20.

22. An antenna apparatus comprising the fixing device according to claim 13.

* * * * *